US012540522B1

(12) United States Patent
Al-Ghamdi

(10) Patent No.: US 12,540,522 B1
(45) Date of Patent: Feb. 3, 2026

(54) SYSTEM AND APPARATUS FOR BLOW OUT PREVENTER COMPONENTS AND STRING PROTECTION

(71) Applicant: SAUDI ARABIAN OIL COMPANY, Dhahran (SA)

(72) Inventor: Bakr Abdulrahim Al-Ghamdi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/792,397

(22) Filed: Aug. 1, 2024

(51) Int. Cl.
*E21B 33/035* (2006.01)
*E21B 33/06* (2006.01)
*E21B 33/08* (2006.01)

(52) U.S. Cl.
CPC ..... *E21B 33/0355* (2013.01); *E21B 33/061* (2013.01); *E21B 33/085* (2013.01)

(58) Field of Classification Search
CPC ..... E21B 33/06; E21B 33/061; E21B 33/062; E21B 33/063; E21B 33/0355
See application file for complete search history.

(56) References Cited

U.S. PATENT DOCUMENTS 4,922,423 A * 5/1990 Koomey ..... E21B 33/063 166/373
7,832,706 B2 * 11/2010 Judge ..... E21B 33/062 166/85.4
8,413,716 B2 * 4/2013 Judge ..... E21B 33/063 251/1.3
8,657,253 B2 2/2014 Judge et al.
8,781,743 B2 * 7/2014 Mckay ..... E21B 33/064 702/9
9,163,471 B2 * 10/2015 Coonrod ..... E21B 47/095
9,347,289 B2 * 5/2016 Judge ..... E21B 33/063
10,767,438 B2 * 9/2020 Papadimitriou ..... E21B 33/064
10,968,731 B2 * 4/2021 Gupta ..... E21B 33/064
11,156,054 B2 * 10/2021 Alsup ..... E21B 33/06
11,499,388 B2 * 11/2022 Papadimitriou ..... E21B 21/001
11,555,372 B1 * 1/2023 Al-Mousa ..... E21B 33/0355
(Continued)

FOREIGN PATENT DOCUMENTS

DE 102012007219 A1 * 10/2013 ..... E21B 33/062
WO WO-2008101005 A1 * 8/2008 ..... E21B 33/063

*Primary Examiner* — Jennifer H Gay
(74) *Attorney, Agent, or Firm* — Vorys, Sater, Seymour and Pease LLP

(57) ABSTRACT

A well system includes a rig system operable from an oil and gas platform, the rig system including at least one of the group consisting of a top drive, a rotary table, a draw works system, and a circulating system. The well system further includes a blowout preventer (BOP) positioned atop and fluidly coupled to a wellhead installation, the BOP including a longitudinal flow path and at least one radially movable member operable to move radially into the flow path to form a seal therein and to move radially out of the flow path. The well system includes at least one sensor arranged to monitor at least one parameter indicative of a position of the radially movable member and a controller communicably coupled to the at least one sensor and the at least one rig system, the controller operable to disable the at least one rig system in response to determining the at least one radially movable member is at least partially disposed within the longitudinal flow path.

17 Claims, 5 Drawing Sheets

(56) References Cited

U.S. PATENT DOCUMENTS

| | | | | |
|---|---|---|---|---|
| 11,982,143 | B2 * | 5/2024 | Ducamin | E21B 33/061 |
| 12,031,392 | B2 * | 7/2024 | Nield | E21B 33/063 |
| 12,188,323 | B2 * | 1/2025 | Owoeye | E21B 33/064 |
| 2008/0197306 | A1 * | 8/2008 | Judge | E21B 33/062<br>251/1.3 |
| 2010/0152901 | A1 * | 6/2010 | Judge | F16K 37/0025<br>706/54 |
| 2012/0197527 | A1 * | 8/2012 | Mckay | E21B 33/064<br>702/6 |
| 2013/0221250 | A1 * | 8/2013 | Judge | F16K 37/0025<br>137/554 |
| 2013/0283919 | A1 * | 10/2013 | Coonrod | E21B 47/095<br>73/632 |
| 2014/0166264 | A1 * | 6/2014 | Judge | E21B 33/063<br>166/66 |
| 2014/0231075 | A1 * | 8/2014 | Springett | E21B 33/064<br>166/250.01 |
| 2014/0311735 | A1 * | 10/2014 | Landrith, II | E21B 34/16<br>166/250.04 |
| 2019/0063175 | A1 * | 2/2019 | Papadimitriou | E21B 44/00 |
| 2019/0112889 | A1 * | 4/2019 | Alsup | E21B 33/06 |
| 2019/0368299 | A1 * | 12/2019 | Jorud | E21B 34/066 |
| 2020/0399974 | A1 * | 12/2020 | Papadimitriou | E21B 21/08 |
| 2022/0282587 | A1 * | 9/2022 | Ducamin | E21B 34/16 |
| 2023/0383613 | A1 * | 11/2023 | Nield | E21B 33/063 |
| 2024/0183243 | A1 * | 6/2024 | Owoeye | E21B 33/064 |
| 2024/0384618 | A1 * | 11/2024 | Katanguri | E21B 33/062 |

* cited by examiner

SYSTEM AND APPARATUS FOR BLOW OUT PREVENTER COMPONENTS AND STRING PROTECTION

FIELD OF THE DISCLOSURE

The present disclosure relates generally to blowout preventers utilized in oil and gas wells and, more particularly, to sensors internally located and operable to confirm the status and/or position(s) of the various movable components included within a blowout preventer.

BACKGROUND OF THE DISCLOSURE

Maintaining well integrity and well control involves a combination of operations, apparatuses and solutions that together enable the containment and control of downhole fluids including hydrocarbons. Effective well integrity thereby serves to reduce the risk of an uncontrolled release of fluids from a wellbore to surface or the atmosphere.

One known apparatus utilized to maintain well integrity and well control is a blowout preventer (BOP). The BOP is a mechanical device installed atop oil and gas wells and is operable to seal wellbore conduits and thereby contain the contents of a well. The BOP includes moving components such as a pair of opposing pistons or "rams" that, when activated, are forced toward one another to create a seal and/or barrier between the well and the atmosphere.

To protect both people and the environment, it is crucial to know the exact positions of the radially moving members of the BOP components at all times during well operations.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a well system may include a rig system operable from an oil and gas platform, the rig system may include at least one of the group consisting of a top drive, a rotary table, a draw works system, and a circulating system. The well system may include a blowout preventer (BOP) positioned atop and fluidly coupled to a wellhead installation, the BOP thereby including a longitudinal flow path and at least one radially movable member operable to move radially into the flow path to form a seal therein and to move radially out of the flow path. The well system may include at least one sensor operatively coupled to the BOP to monitor at least one parameter indicative of a position of the radially movable member and a controller communicably coupled to the at least one sensor and the rig system, the controller may be operable to disable the rig system in response to determining the at least one radially movable member is at least partially disposed within the longitudinal flow path.

According to an embodiment consistent with the present disclosure, a method may include extending a drill string from an oil and gas platform with a rig system including at least one of the group consisting of a top drive, a draw works system, and a circulating system, into a wellbore and through a blowout preventer (BOP) positioned atop and fluidly coupled to a wellhead installation. The BOP may include a longitudinal flow path and at least one radially movable member operable to move radially into the flow path to form a seal therein and to move radially out of the flow path and at least one sensor operatively coupled to the BOP to monitor at least one parameter indicative of a position of the radially movable member. The method may include detecting data indicative of the position of an internal movable member, by the one or more sensors, transmitting data indicative of the position of the internal movable member to a controller communicably coupled to the at least one sensor and the rig systems and determining, by the controller, that at least one radially movable member is extended into the flow path. The method may also include conveying a disabling signal from the controller to the at least one rig system and disabling the at least one rig system.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
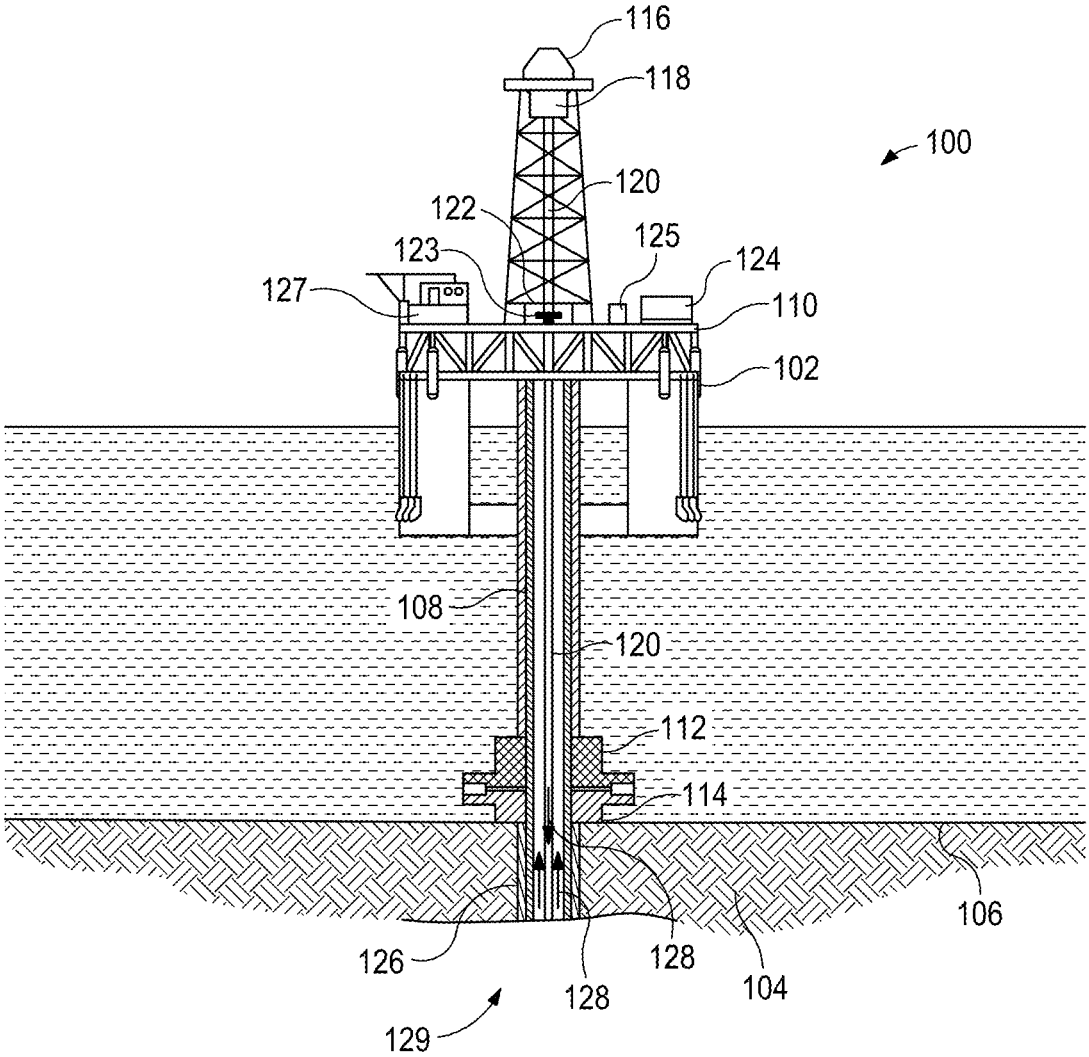
FIG. 1 is a schematic diagram of an example well system including a BOP, according to one or more embodiments of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to blowout preventer (BOP) stacks utilized in oil and gas wells and, more particularly, to sensors positioned internally within a BOP component, operable to confirm a status of the BOP component, such as open and closed positions of pipe rams or other components included within the BOP stack. Well integrity, while integral to all phases of the life of the well, is particularly critical during an initial construction of the wellbore. During wellbore construction, permanent, semi-permanent, or temporary well barriers are installed to prevent downhole fluids (e.g., formation fluids, injected fluids, etc.) from uncontrollably or inadvertently flowing to surface. Generally, throughout the life of the well, most of the well barriers installed during wellbore construction remain in place. A BOP is a critical, temporary well barrier that is utilized during wellbore construction and well intervention. The BOP may be selectively activated to create a sealed barrier between a well that contains flowing hydrocarbons and the surface (atmosphere). Upon activation, the BOP is capable of scaling with an external surface of a tubular to prevent flow through an annulus around the tubular, or in the alternative, the BOP may prevent flow through an interior of the tubular by completely shutting in on itself, and in some configurations, shearing the tubular and generating a seal and barrier between the wellbore and the atmosphere. The BOP is thereby configured to prevent an uncontrolled release of fluids from the wellbore to surface.

During well operations, it is critical to have knowledge of the wellbore components (e.g., tubulars, downhole tools, drill strings, etc.) that may be positioned across (or positioned within) the BOP, as well as knowledge of the internal BOP components at any given time. Knowledge is particularly critical when the BOP is activated by an operator. In some instances, drill strings, work strings and/or other tubulars have been inadvertently damaged or sheared because the BOP was activated with a lack of knowledge of the position of the scaling and shearing components of the BOP. In other instances, internal components included with the BOP have been damaged for the same reason. Accordingly, a system and method to better determine the position and/or state of the BOP components is desirable.

FIG. 1 is a schematic illustration of an example well system 100, according to one or more embodiments of the present disclosure. As illustrated, the well system 100 may include an offshore oil and gas platform 102 positioned above a submerged hydrocarbon-bearing formation 104 located below a sea floor 106. A subsea conduit or riser 108 extends from a deck 110 of the platform 102 to a blowout preventer stack 112 (hereinafter referred to as the "BOP stack 112") positioned atop a wellhead installation 114. The platform 102 may include a derrick 116 and a hoisting apparatus or top drive 118 for raising and lowering pipe strings or tubulars, such as a drill string 120. The platform 102 may also include a draw works system 122 configured to retain and operate drill line (not shown). The drill line may be operatively coupled to the top drive 118 and thereby enable the lowering and/or lifting of the top drive 118 at the direction of an operator (driller). A circulating system 124 (including at least a configuration of mud pumps) may also be located on the platform 102. The circulating system 124 may be operable to circulate drilling fluid (mud) throughout the well system 100.

A controller 125, as depicted in FIG. 1, may be positioned on the platform 102 and may be operatively coupled to several system components and/or rig systems comprising portions of the well system 100. For example, the controller 125 may be operably coupled to rig systems including but not limited to, the top drive 118, the draw works system 122, the rotary table 123, the circulating system 124, the BOP stack 112 and the wellhead installation 114. The controller 125 may be operable to receive data from, and transmit command signals to, the system components within the well system 100 to which the controller 125 is coupled. The controller 125 may also be communicably coupled to a rig computer system 127 operable to transmit and receive data to and from the controller 125. The rig computer system 127 may be positioned on the platform 102 and configured for use by an operator. In some embodiments, the rig computer system 127 may include a screen (not shown) or some means of visualization. The rig computer system 127 may also include a means of input (e.g., a keyboard (not shown)) to enable the operator to communicate with the rig computer system 127.

In accordance with aspects of the present disclosure, the controller 125 may receive indication that the BOP stack 112, or a portion of the BOP stack 112, is in a closed position, as discussed in further detail below. Upon receiving said indication, the controller 125 may thereafter shut down, or render inoperable, any of the other operatively coupled rig systems of the well system 100. Similarly, in the same example, the controller 125 having transmitted the BOP stack 112 position to the rig computer system 127 may thereafter receive and transmit commands to the appropriate rig system, at the direction of the operator, by way of the rig computer system 127.

While the well system 100 depicts the use of the offshore platform 102, it will be appreciated that the principles of the present disclosure are equally applicable to other types of oil and gas rigs or installation, such as land-based drilling and production rigs, service rigs, and other wellhead installations located at any geographical location. As used herein, the term "operatively couple" and variations thereof refers to a direct or indirect coupling engagement between two components.

In the example embodiment, a wellbore 126 extends from and below the wellhead installation 114 and through various earth strata, including the formation 104. A configuration 129 of casings and liners may extend from the wellhead installation 114 into the wellbore 126 and may be cemented into place. As shown, the drill string 120 also extends into the wellbore 126. The drill string 120 is operatively coupled to and extends from the top drive 118 passing through the deck 110, the BOP stack 112, the wellhead installation 114 and into the wellbore 126. A portion of the drill string 120 may thereby be positioned within the configuration of casings and liners while some portion of the drill string 120 may be adjacent to an open-hole section (not shown) of the wellbore 126. Accordingly, those of ordinary skill will recognize that the wellbore 126 may comprise any directional path (i.e., vertical well, horizontal well or otherwise) with any configuration of casings, liners and open-hole segments, without departing from the scope of this disclosure.

Generally, a primary mechanism to maintain well control during drilling operations is a drilling fluid 128. Accordingly, in some embodiments the drilling fluid 128 may exhibit a fluid weight (density) that exceeds the natural pressure of the formation 104 being drilled to prevent formation fluids from entering the wellbore 126. A secondary mechanism to maintain well control during drilling operations (as disclosed in the example embodiments) and otherwise, is the BOP stack 112. In the example embodiments disclosed herein the BOP stack 112 may comprise a configuration of various BOP components, each designed to maintain well control.

Figure 2:
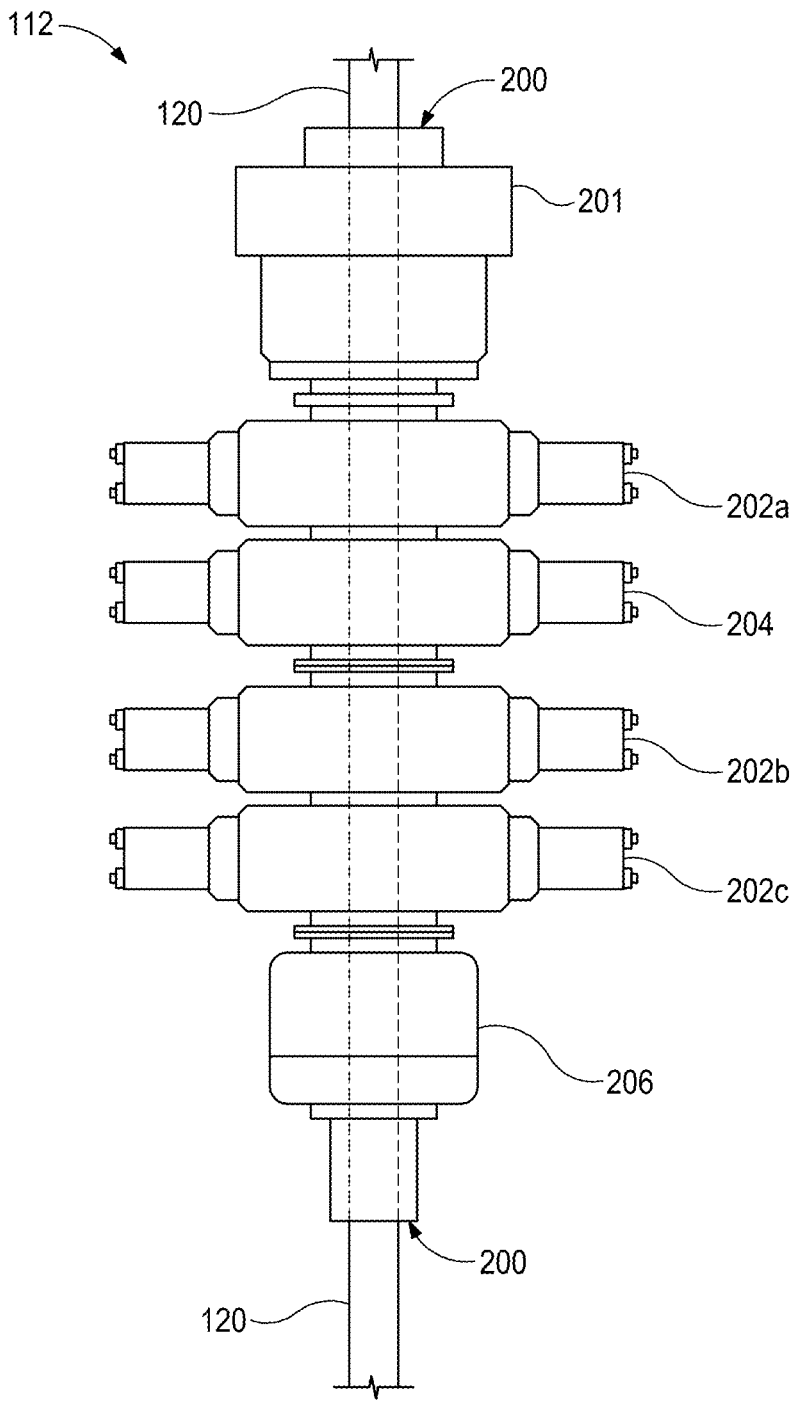
FIG. 2 is an enlarged schematic view of the BOP of FIG. 1 illustrating an annular preventer, a plurality of pipe rams and a blind shear ram, according to one or more embodiments of the present disclosure.

FIG. 2 is a schematic side-view of the BOP stack 112, according to one or more embodiments of the present disclosure. The BOP stack 112 may include a flow path 200 extending longitudinally therethrough. The flow path 200 permits drilling fluid 128 (FIG. 1) to flow into and out of the wellbore 126 (FIG. 1), and for the drill string 120 to travel therethrough. The flow path 200 is defined through various BOP components such as an annular preventer 201, a plurality of pipe rams 202*a-c*, and a blind shear ram 204, as well as a wellhead connector 206 stacked with the BOP components 201, 202*a-c*, 204.

Both the pipe rams 202*a-c* and the blind shear ram 204 include movable internal members operable to extend radially into the flow path 200 which is defined by the interior diameters of the BOP components 201, 202*a-c*, 204, 206. In particular, the pipe ram 202*a* includes internal members that move radially inward to generate a seal about the drill string 120 (FIG. 1) within the flow path 200. The blind shear ram 204 includes internal members that move radially inward to generate a seal of (barrier within) the flow path 200 regardless of the presence or absence of the drill string 120 within the flow path 200. In some configurations the BOP stack 112 may include additional BOP components including but not limited to a shear ram and/or a blind ram. Accordingly, the BOP stack 112 may comprise any number of the aforementioned components, arranged in an order desired and/or dictated by the formation 104 and the wellbore 126. Similarly, the BOP stack 112 and its BOP components 201, 202*a-c*, 204 may be sized in accordance with the needs and requirements of the formation 104, the operator's procedural requirements and any applicable regulatory requirements.

In the illustrated example embodiment, the single blind shear ram 204 interposes the first pipe ram 202*a* and the second pipe ram 202*b*. Each of the BOP components are operatively to and positioned atop (stacked upon) the wellhead connector 206. The wellhead connector 206 thereby enabling fluid communication between the BOP stack 112, the wellhead installation 114 and the wellbore 126.

Figure 3A:
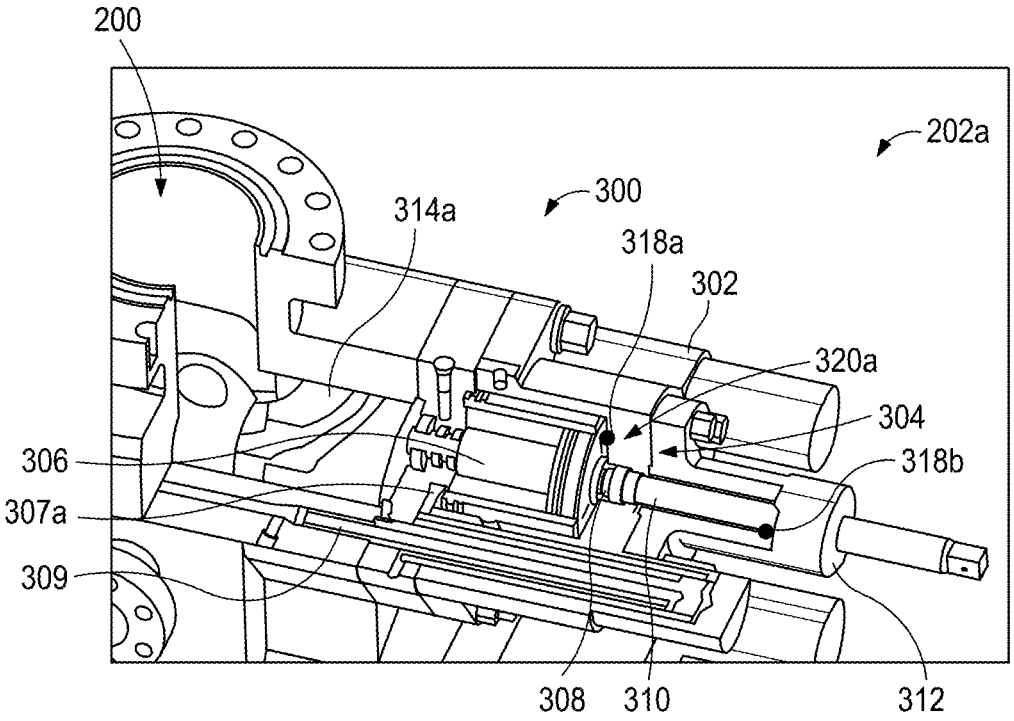
FIGS. 3A and 3B are partial, sectional views of one of the example pipe rams of FIG. 2 in "open" and "closed" configurations, respectively.
Figure 3B:
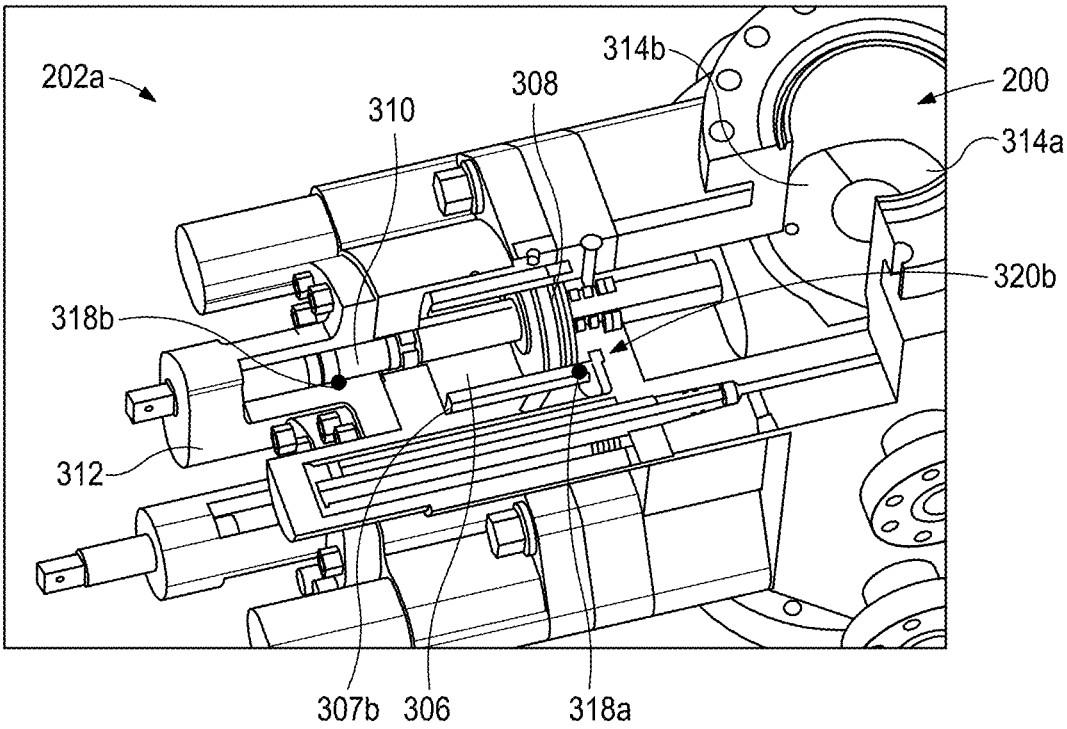

FIGS. 3A-3B are enlarged, schematic views of the example first pipe ram 202*a*. The pipe ram 202*a* is representative of the internal workings of the other two pipe rams 202*b-c*, and similarly, the blind shear ram 204. Accordingly, the following description of the first pipe ram 202*a* is equally applicable to the two second and third pipe rams 202*b,c* and the blind shear ram 204. As mentioned, the pipe rams 202*a-c* and the blind shear ram 204 each include movable internal members operable to extend radially into the flow path 200. In particular, the pipe ram 202*a* includes internal members that move radially inward to generate a seal about the drill string 120 (FIG. 1-2) within the flow path 200. The blind shear ram 204 includes internal members that move radially inward to generate a seal of (barrier within) the flow path 200 regardless of the presence or absence of the drill string 120 within the flow path 200.

Referring first to FIG. 3A, the pipe ram 202*a* is illustrated in an "open" configuration in which the flow path 200 is unobstructed. The pipe ram 202*a* includes a body 300 comprising a hollow interior (making up a portion of the flow path 200) and an actuator housing 302 protruding radially from the body 302. The actuator housing 302 is configured to retain an actuator assembly 304, which is operable to move the pipe ram 202*a* to a closed configuration (see FIG. 3B) as described in greater detail below. In the illustrated embodiment, the actuator assembly 304 includes a cylinder 306 configured to receive and retain hydraulic fluid, a piston 308 radially movable within the cylinder 306 and a piston rod 310 operatively coupled to the piston 308. The piston rod 310 extends through an interior of both the piston 308 and the cylinder 306. The piston rod 310 may be partially housed within a piston cavity 312 comprising a distal most portion of the actuator housing 302, relative to the flow path 200.

The pipe ram 202*a* further includes a pair of opposing ram blocks 314*a* (FIG. 3A) and 314*b* (FIG. 3B), operably coupled to a respective piston rod 310 to move into or out of the flow path 200, from two opposing radial directions. The ram blocks 314*a,b* may comprise materials that include rubber (or any known elastomer), steel, and any combination thereof. In the "open" configuration of FIG. 3A, both ram bocks 314*a,b* are retracted away from the flow path 200. To fully retract the ram block 314*a* away from the flow path 200 and thereby open the pipe ram 202*a*, an operator may pump hydraulic fluid, through a plurality of hydraulic fluid lines 309, into the cylinder 306 via a first injection port 307*a*. Consequently, the hydraulic fluid pushes the piston 308 radially outward (toward the distal end of the piston cavity 312) thereby causing the operatively coupled piston rod 310 and ram block 314*a* to move in the same direction.

During operations (for example, drilling, completion, intervention or otherwise), to avoid damage to the drill string 120 (FIG. 2) or to the internal components of the pipe ram 204*a*, the pipe ram 202*a* should be in a completely open configuration. Potential, costly damage to both the drill string 120 and the pipe ram 204*a* can occur if the pipe ram 204*a* is not fully open when necessary. Accordingly, it is critical and advantageous that the operator know the exact configuration of the pipe ram 202*a* (and similarly the other components of the BOP stack 112) during any operations.

Systems and methods currently exist to determine the respective configuration, location and/or position of the BOP stack 112 components. But existing methods are often unreliable or based upon measurements that are not truly indicative of the configuration of the BOP stack 112 components.

According to embodiments of the present disclosure, systems and methods that are accurate and simple in execution may be implemented to determine the exact locations of the internal moving members of the respective BOP stack 112 components. Based on the exact locations determined, rig systems may be disabled or other safety measures may be implemented.

A plurality of sensors, operable to monitor at least one parameter indicative of a position of the movable member of the respective BOP stack 112 components, may be included within the actuator housing 302 or at other locations within the wellbore system 100 (FIG. 1). The sensors may be configured and operable to transmit a signal indicative of the parameter and/or the location/position information to the controller 125 located on the platform 102 (FIG. 1). A signal indicative of the location/position information may be transmittable to an operator from the controller 125. The sensors may comprise limit switches, proximity sensors/switches, photoelectric sensors, ultrasonic sensors, capacitive or inductive sensors or any other known sensor configurable to detect an object's presence.

In the illustrated example, a first sensor 318*a* may be positioned on or within the piston 308 and a second sensor 318*b* may be positioned on or within the piston rod 310. When the ram bock 314*a* is fully retracted, the first sensor 318*a* may be in contact with a first end 320*a* of the cylinder 306 and the second sensor 318*b* may be in contact with the distal most end of the piston cavity 312. In some embodiments the sensors 318*a,b* may sense the proximity to and/or a distance from the first end 320*a* and distal most end of the piston cavity 312. Depending upon the type of sensor 318*a,b*, a signal indicative of the location of the respective sensor 318*a,b* may thereafter be transmittable to the controller 125 to inform the operator of the position of the respective ram blocks 314*a,b*. In other embodiments, the sensors 318*a,b* may be mounted in a stationary location within the cylinder 306 and the piston cavity 312 to sense the location of the movable piston 308 and piston rod 310.

Referring now to FIG. 3B, the pipe ram 202*a* is depicted in a "closed" configuration. To close the pipe ram 202*a*, the operator may pump hydraulic fluid, by way of the hydraulic fluid lines 309 into the cylinder 306 via a second injection port 307*b*. The injection of the hydraulic fluid pushes the piston 308 radially inward toward the flow path 200 causing the operatively coupled piston rod 310 and ram block 314*a* to move in the same direction. The pipe ram 202*a* is closed when both ram blocks 314*a,b* are fully extended into the flow path 200. The ram blocks 314*a,b* form a seal about the exterior body of the drill string 120 (FIG. 2) creating a barrier to fluid. When the ram blocks 314*a,b* are extended into the flow path 200, the first sensor 318*a* may thereby be positioned at a second end 320*b* of the cylinder and the second sensor 318*b* may thereby be positioned radially inward and some distance away from the most distal end of the piston cavity 312. Accordingly, the respective sensor 318*a,b* data may be transmitted to the controller 125 to inform the operator of the position of the respective ram blocks 314*a,b*.

In embodiments where the sensors 318*a,b* comprise limit switches, the first sensor 318*a* upon making direct physical contact with the first end 320*a* of the cylinder 306, may be actuated to record and/or transmit its activation and/or location information to the controller 125. In embodiments where the sensors 318*a,b* comprise proximity sensors, the first sensor 318*a* may be actuated to record and/or transmit data to the controller 125 when the sensor 318*a* is within a predetermined (preset) distance of the first end 320*a*. In some embodiments, the sensors 318*a,b* may be configured to transmit a continuous electric current to the controller 125 whenever the ram blocks 314*a,b* are in a completely open position. The sensors 318*a,b* may also be configured to interrupt the electric current when the ram blocks 314*a,b* are moved to any partially or completely closed position. The controller 125 may thus detect the current to confirm the ram blocks 314*a,b* are in the completely open position.

In one embodiment, the controller 125 may transmit the data acquired by the first and second sensors 318*a,b* to an operator via the rig computer system 127 (FIG. 1). The controller 125 may transmit the data from the sensors 318 to the rig computer system 127 thereafter visible to the operator and indicative of the position of the moveable members of the associated BOP component. The operator may then determine a course of action and generate commands commensurate with the operationally desirable operation. The commands may then be transmitted from the rig computer system 127 to the controller 125. For example, based on data informing the position of the respective ram blocks 314*a,b*, the operator may generate commands to direct the respective BOP stack 112 components to open, close, or otherwise adjust/change their position (i.e., pipe rams 202*a-c*, blind shear ram 204, etc. Alternatively, or in some cases, simultaneously, the operator, may generate and transmit commands to enable or disable other applicable rig systems including but not limited to the draw works system 122, the top drive 118, the rotary table 123, the circulating system 124 and the like. The operator may generate and transmit commands via the rig computer system 127 to disable all or a part of the applicable rig system. For example, where the first and second sensors 318*a,b* indicate to the controller 125 that the ram blocks 314*a,b* are fully extended into the flow path 200, the operator may generate a command to disable the draw works system 122 thereby preventing movement of the top drive 118.

In another embodiment, the controller 125, upon receiving data from the first and second sensors 318*a,b*, may generate and transmit commands to the applicable BOP stack 112 components and systems, automatically. For example, upon confirmation that the pipe ram 202*a* is closed (FIG. 3B), the controller 125 may automatically command the draw works system 112 to stop any movement of the top drive 118 (FIG. 1). A similar command may be sent to the circulating system 124 (FIG. 1) to prevent any circulation of the drilling fluid 128 (FIG. 1). The controller 125 may also simultaneously trigger a set of alarms configured to alert the operator (or multiple operators) via the rig computer system 127. After which, the operator may override said alarms or similarly, manually operate any BOP stack 112 component or applicable system (e.g., circulating system 124, draw works system 122, etc.) necessary.

In embodiments where the sensors 318*a,b* comprise proximity sensors, the controller 125 may transmit similar commands. For example, the sensors 318*a,b* may indicate the pipe ram blocks 314*a,b* (FIGS. 3A-B) are partially extended into or partially retracted away from, the flow path 200. In such an example, upon receiving data from the sensors 318*a,b*, the controller 125 may transmit preprogrammed/predetermined commands operable to direct the communicably coupled rig systems (e.g., circulating system 124, draw works system 122, etc.) when a threshold distance is met or exceeded. Here again, the controller 125 may trigger a set of alarms to inform the operator via the rig computer system 127.

In some embodiments, the sensors 318*a,b* may be directly communicably coupled to various systems within the well system 100. In such an embodiment, a sensor 318*a,b* position could thereby trigger the automatic shutdown of the respective system. For example, a first and second sensor 318*a,b* indicating the pipe ram 202*a* is fully closed could trigger the draw works system 122 to shut down by signaling to the top drive 118 actuation of the brake. In another embodiment, the first and second sensor 318*a,b* could trigger the shutdown of the draw works system 122 by signaling the stoppage of the draw works system 122 motors. In an operation where the controller 125 also generates an alarm, operator(s) may be able to override an automatic shutdown of any communicably coupled rig system.

Figure 4:
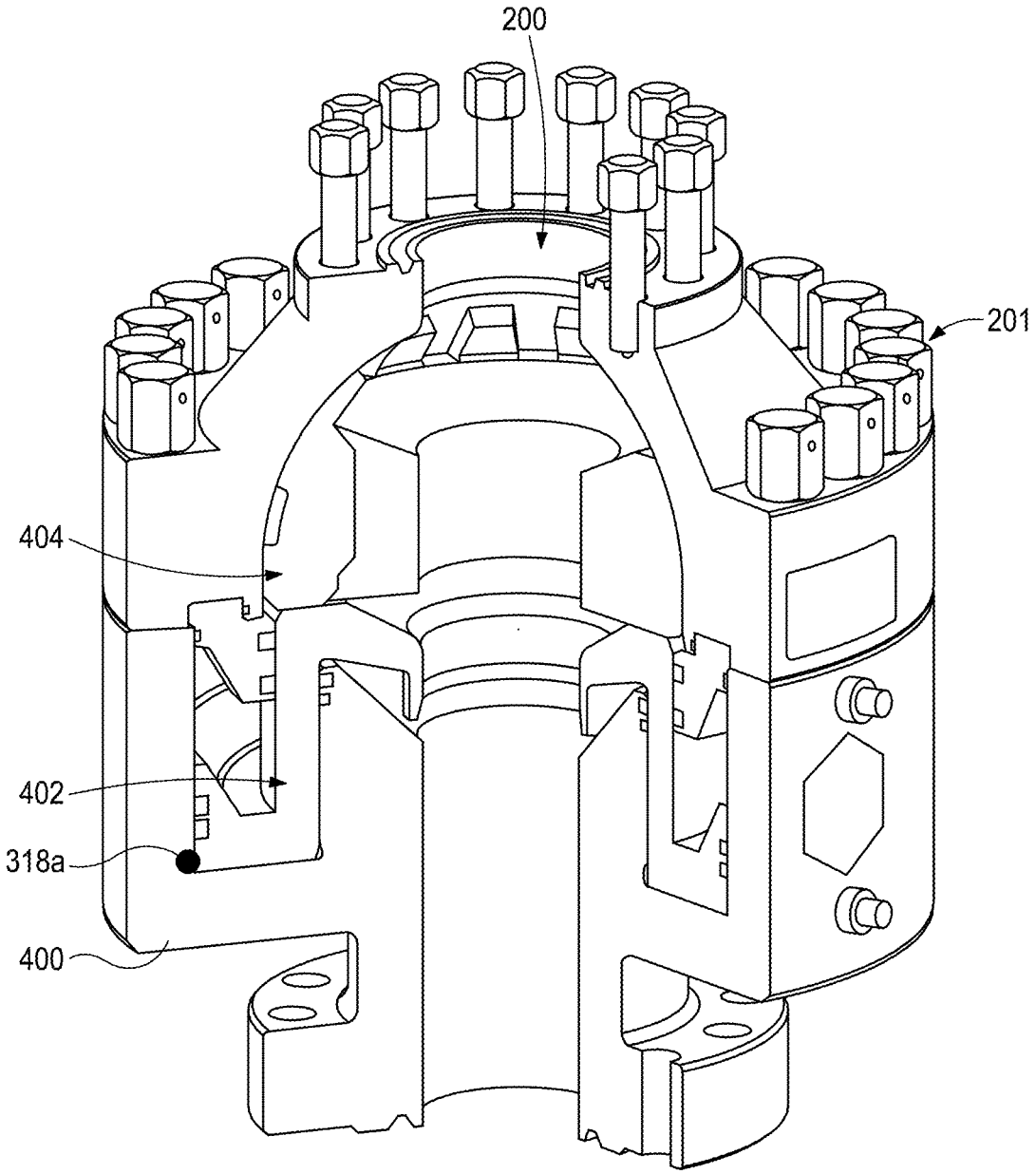
FIG. 4 is a partial, sectional view of the annular preventer of FIG. 2, according to one or more embodiments of the present disclosure.

FIG. 4 is an enlarged, schematic view of the annular preventer 201, according to one or more embodiments of the present disclosure. The annular preventer 201 comprises a housing 400 configured to retain at least a piston 402 and a packing element 404. The annular preventer 201, like the pipe rams 202*a-c* may be actuated via hydraulic fluid pumped by the operator. Injected hydraulic fluid may actuate the piston 402 and push the packing element 404 upward against the housing 400, thereby radially extending packing element radially inward until a seal/barrier is created within the flow path 200. More particularly, the internal annular packing element 404 is extended from all radial directions around the flow path 200 to create a seal within the flow path regardless of the presence of the drill string 120 (FIG. 2).

The annular preventer 201, like the pipe ram 202*a*, may include one or more sensors positioned and configured to transmit information regarding the state (i.e., open, closed, partially open, partially closed) of the annular preventer 201 to the controller 125 (FIG. 1) to inform the operator. In the illustrated example embodiment, a first sensor 318*a* comprising a limit switch may be positioned within the base of the housing 400. The first sensor 318*a* may be activated when in direct contact with the piston 402. Once activated, the first sensor 318*a* may transmit its activation data, location data, and/or data indicative of the annular preventer 201 state, to the communicably coupled controller 125. In one embodiment, where the first sensor 318*a* comprises a limit switch, activation of the first sensor 318*a* may indicate that the annular preventer 201 is fully "open" such that the packing element 404 is retracted away from the flow path 200. In such an example embodiment, a lack of signal from the 318*a* sensor may indicate that the annular preventor 201 is at least partially "closed," such that the packing element 404 may be extended into the flow path 200 at least some distance. The controller 125, as discussed above, may transmit the data to the rig system computer 127, thereafter observable by an operator. The operator may then direct the controller 125 as operationally necessary. In the alternative, the controller 125 may transmit commands directly to the appropriate rig system based upon predetermined/preselected responses to data received from the first sensor 318*a*. In other embodiments, the first sensor 318*a* may comprise a proximity sensor. Accordingly, the first sensor 318*a* may transmit and receive data from the controller 125 in the same ways as discussed in reference to the pipe ram 202*a*, above.

Accordingly, the annular preventer 201, the blind shear ram 204 (FIG. 4) and the other pipe rams 202*b-c* not specifically discussed, may include any configuration of sensors 318 positioned to inform the location/position of the components to which they are coupled. The data acquired by the sensors 318 transmitted to the controller 125 thereby provides accuracy in determining the exact location of the respective internal radially movable members.

Figure 5:
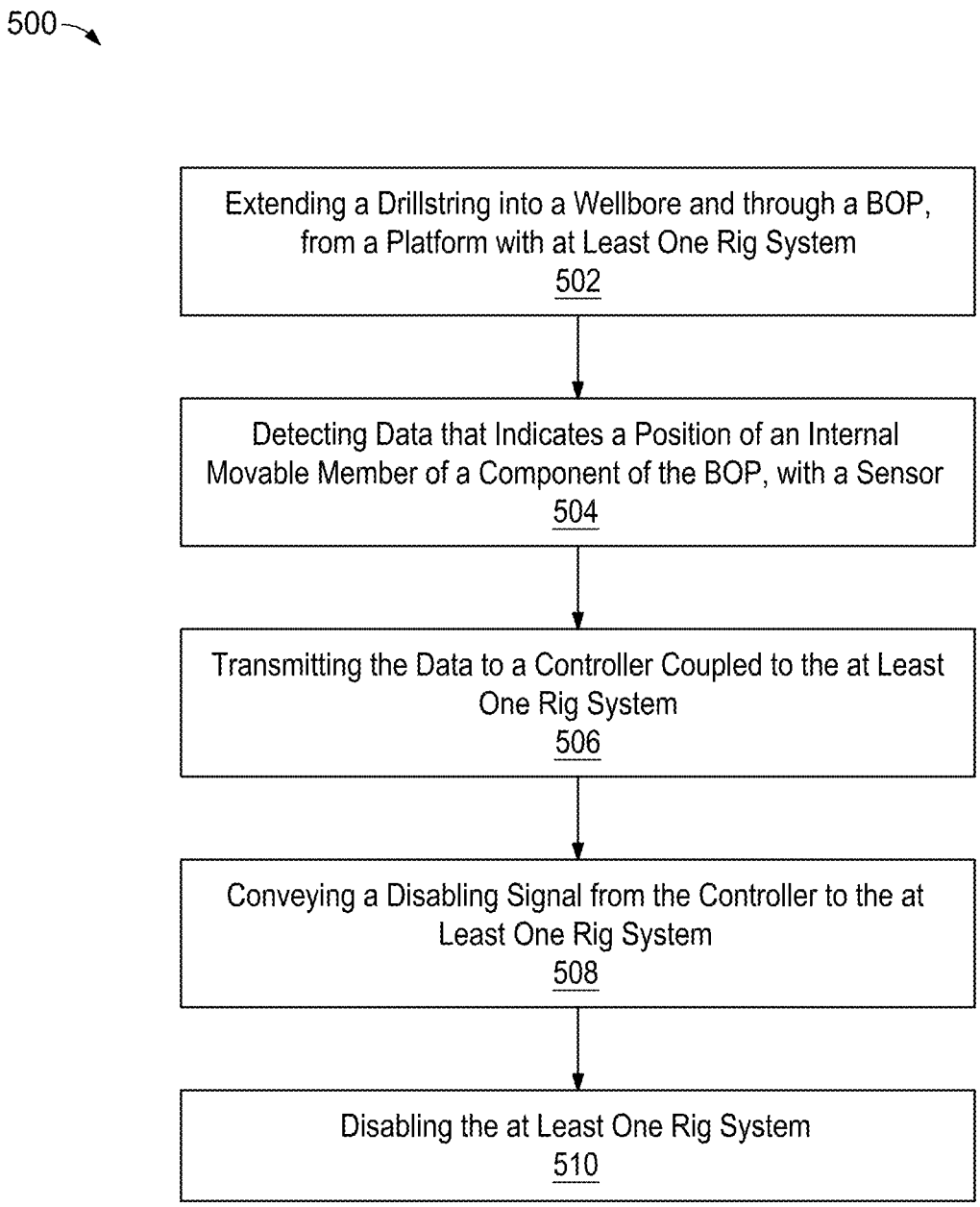
FIG. 5 is a flowchart illustrating an example procedure for operating the well system of FIG. 1 in accordance with at least one embodiment of the present disclosure.

FIG. 5 is a schematic flowchart of an example method 500, according to the principles of the present disclosure. The method 500 may include extending a drill string from an oil and gas platform into a wellbore and through a BOP stack positioned atop and fluidly coupled to a wellhead installation, as at 502. The rig system may include a top drive, a rotary table, a draw works system and a circulating system. The BOP may include a longitudinal flow path and BOP components that may include but are not limited to an annular preventer, one or more pipe rams and a blind shear ram. Each BOP component may include at least one radially movable member that may be operable to move radially into and out of the flow path. The inward movement thereby forming a seal in the flow path. The BOP component may include one or more sensors arranged to monitor at least one parameter indicative of a position of the at least one radially movable member. The method 500 may include detecting data indicative of the position of the at least one radially movable member, by the one or more sensors, as at 504. The method 500 may include, transmitting the data indicative of the position of the at least one radially movable member to a controller operably and communicably coupled to the at least one sensor and the one or more rig systems, as at 506. The controller may be positioned on the oil and gas platform. The rig systems may include but are not limited to the draw works system, the circulating system, the rotary table and top drive system. The method 500 may include, conveying a disabling signal from the controller to the at least one rig system upon determining with the controller that the at least one radially movable member is extended into the flow path, as at 508. Lastly and consequently, the method 500 may include disabling the at least one rig system upon receipt of the disabling signal, as in step 510.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A well system, comprising:

a rig system forming part of an oil and gas platform and including at least one of a top drive, a rotary table, a draw works system, and a circulating system;

a blowout preventer (BOP) positioned atop and fluidly coupled to a wellhead installation, the BOP including a longitudinal flow path and at least one radially movable member operable to move radially into the flow path to form a seal therein and to move radially out of the flow path;

a piston rod operably coupled to the at least one radially movable member to move radially along with the radially movable member;

an actuator housing defining a piston cavity therein and through which the piston rod moves as the at least one radially movable member moves into and out of the flowpath;

at least one sensor arranged within the piston cavity to monitor at least one parameter indicative of a position of the at least one radially movable member; and a controller communicably coupled to the at least one sensor and the rig system, the controller operable to disable the rig system in response to determining that the at least one radially movable member is at least partially disposed within the longitudinal flow path;

wherein the at least one sensor includes a first sensor carried by the piston rod and operable to detect proximity to a distal most end of the piston cavity;

wherein the first sensor is in contact with the distal most end of the piston cavity when the at least one radially movable member is in an open position and radially out of the flow path;

wherein the at least one sensor further includes a second sensor that is disposed within a cylinder and is radially spaced from the first sensor; and wherein the cylinder is operable to receive a hydraulic fluid to move a piston operably coupled to the at least one radially movable member and the piston rod in a radial direction.

2. The well system of claim 1, wherein the at least one sensor is selected from the group consisting of a limit switch, a proximity sensor, a photoelectric sensor, an ultrasonic sensors, a capacitive sensor, an inductive sensor, and any combination thereof.

3. The well system of claim 1, wherein the BOP comprises BOP components including one or more of an annular preventer, a pipe ram, a blind ram, a blind shear ram and a shear ram.

4. The well system of claim 3, wherein the longitudinal flow path is defined by interior diameters of the BOP components.

5. The well system of claim 4, wherein the at least one radially movable member forms part of the pipe ram and comprises a pair of opposing ram blocks moveable radially inward toward one another to generate a seal about a drill string disposed within the flow path.

6. The well system of claim 4, wherein the at least one radially movable member forms part of the annular preventer and comprises a packing element extendable radially inward in response to a longitudinal force applied to the packing element.

7. The well system of claim 1, wherein the controller is operable to receive and transmit data received from the at least one sensor, the well system further comprising a rig computer system communicably coupled to and operable to receive data from the controller.

8. The well system of claim 7, wherein the rig computer system is configured to trigger alarms recognizable by an operator and operable to transmit operator generated commands to the controller.

9. The well system of claim 8, wherein the rig computer system is operable to transmit commands to the controller.

10. The well system of claim 1, wherein the second sensor is carried by the piston and operable to detect a proximity to a first end of the cylinder.

11. The well system of claim 10, wherein the second sensor is in contact with the first end of the cylinder when the at least one radially movable member is in the open position.

12. A method, comprising:

extending a drill string from an oil and gas platform with at least one rig system from the group consisting of a top drive, a draw works system, and a circulating system, into a wellbore through a blowout preventer (BOP) positioned atop and fluidly coupled to a wellhead installation and into a wellbore, the BOP including:

a longitudinal flow path and at least one radially movable member operable to move radially into the flow path to form a seal therein and to move radially out of the flow path;

a piston rod operably coupled to the at least one radially movable member to move radially along with the at least one radially movable member;

an actuator housing defining a piston cavity therein through which the piston rod moves as the at least one radially movable member moves into and out of the flowpath; and at least one sensor arranged within the piston cavity to monitor at least one parameter indicative of a position of the at least one radially movable member, wherein the at least one sensor includes a first sensor carried by the piston rod and operable to detect proximity to a distal most end of the piston cavity, wherein the first sensor is in contact with the distal most end of the piston cavity when the at least one radially movable member is an open position and radially out of the flow path and wherein the at least one sensor further includes a second sensor that is disposed within a cylinder and is radially spaced from the first sensor; and wherein the cylinder is operable to receive a hydraulic fluid to move a piston operably coupled to the at least one radially movable member and the piston rod in a radial direction;

detecting data indicative of the position of the at least one radially movable member, by the at least one sensor;

transmitting data indicative of the position of the at least one radially movable member to a controller in communication with to the at least one sensor and the at least one rig system;

conveying a disabling signal from the controller to the at least one rig system upon determining with the controller that the at least one radially movable member is extended into the flow path; and disabling the at least one rig system upon receipt of the disabling signal.

13. The method of claim 12, further comprising:

transmitting the data indicative of the position of the at least one radially movable member from the controller to a rig computer system located on the oil and gas platform; and triggering alarms observable by the operator using the rig computer system.

14. The method of claim 13, further comprising deactivating the alarms once acknowledged by an operator.

15. The method of claim 12, wherein the at least one sensor is selected from the group consisting of a limit switch, a proximity sensor, a photoelectric sensor, an ultrasonic sensor, a capacitive sensor, an inductive sensor, and any combination thereof.

16. The method of claim 12, further comprising generating a seal about a drill string disposed within the longitudinal flow path.

17. The method of claim 12, further comprising generating a seal within the flow path in an absence of a drill string within the longitudinal flow path.

* * * * *